US009016328B2

(12) United States Patent
Ferraiolo

(10) Patent No.: US 9,016,328 B2
(45) Date of Patent: Apr. 28, 2015

(54) PROTECTIVE METAL NETTING WITH INTERWOVEN WIRES, AND A MACHINE AND A METHOD FOR ITS MANUFACTURE

(75) Inventor: Francesco Ferraiolo, Ca' de' Fabbri (IT)

(73) Assignee: Officine Maccaferri S.p.A., Zola Predosa (IT)

( * ) Notice: Subject to any disclaimer, the term of this patent is extended or adjusted under 35 U.S.C. 154(b) by 117 days.

(21) Appl. No.: 13/394,708

(22) PCT Filed: Sep. 10, 2010

(86) PCT No.: PCT/IB2010/054100
§ 371 (c)(1),
(2), (4) Date: Mar. 7, 2012

(87) PCT Pub. No.: WO2011/030316
PCT Pub. Date: Mar. 17, 2011

(65) Prior Publication Data

US 2012/0205496 A1 Aug. 16, 2012

(30) Foreign Application Priority Data

Sep. 10, 2009 (IT) ..... BO2009A0576

(51) Int. Cl.
*B21F 27/00* (2006.01)
*B21F 27/06* (2006.01)

(52) U.S. Cl.
CPC ..... *B21F 27/005* (2013.01); *B21F 27/06* (2013.01)

(58) Field of Classification Search
CPC ..... B21F 27/00; B21F 27/06; B21F 27/08; B21F 27/005; B21F 29/00; B21F 29/02
USPC ..... 140/3 A, 4, 6, 7, 92.3–92.94; 245/2, 4–9
See application file for complete search history.

(56) References Cited

U.S. PATENT DOCUMENTS 459,929 A * 9/1891 Conner ..... 273/246
529,093 A * 11/1894 Wright ..... 140/6

(Continued)

FOREIGN PATENT DOCUMENTS

FR 761 904 3/1934
GB 280 542 12/1927

OTHER PUBLICATIONS

Form PCT/ISA/210 mailed Jan. 12, 2011 (4 pages).

(Continued)

*Primary Examiner* — Teresa M Ekiert
(74) *Attorney, Agent, or Firm* — Flynn, Thiel, Boutell & Tanis, P.C.

(57) ABSTRACT

A protective metal netting comprises a plurality of longitudinal metal wires or cables (10) side by side, each interwoven with at least one adjacent longitudinal wire or cable (10) in an interweave portion (24), in which at least one of the metal wires or cables (20) has an almost rectilinear development, or in any case with loops that are less pronounced than the lower-strength neighboring cables. A machine for manufacturing interwoven metal nettings comprises a cylindrical drum (50), on the outer surface of which a plurality of pins (52) protruding radially and arranged in axial rows at equal angular intervals is fixed, with an equal pitch in all the rows. Some pins (54) present on the cylindrical drum (50) are fitted out-of-alignment with respect to the above-mentioned pitch.

12 Claims, 1 Drawing Sheet

(56) References Cited

U.S. PATENT DOCUMENTS

Figure 1:
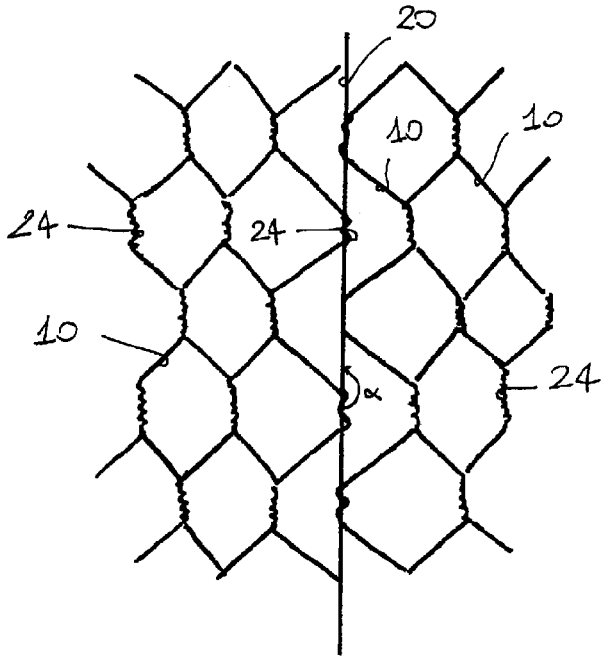

| | | | | |
|---|---|---|---|---|
| 1,195,688 | A * | 8/1916 | Kilmer | 140/4 |
| 1,401,557 | A | 12/1921 | Riviere et al. | |
| 1,859,831 | A | 5/1932 | Land | |
| 2,053,221 | A | 9/1936 | Kitselman | |
| 2,929,239 | A | 3/1960 | Dahlhauser et al. | |
| 4,081,159 | A * | 3/1978 | Baldwin | 245/2 |
| 4,209,153 | A | 6/1980 | Vanvlaenderen | |
| 2007/0079985 | A1 | 4/2007 | Ferraiolo | |

OTHER PUBLICATIONS

Form PCT/ISA/237 mailed Jan. 12, 2011 (7 pages).

Italian Search Report issued in Application No. BO20090576 dated Jul. 9, 2010 with English translation of Categories of Cited Documents (10 pages).

* cited by examiner

PROTECTIVE METAL NETTING WITH INTERWOVEN WIRES, AND A MACHINE AND A METHOD FOR ITS MANUFACTURE

The present invention relates to the sector of containment and protection structures, and in particular to the sector of metal nettings with interwoven wires. The invention has been developed with particular regard to a protective metal netting with meshes comprising a plurality of longitudinal metal wires or cables side by side, each interwoven with at least one adjacent longitudinal wire or cable.

A number of typologies of containment and protection metal nettings are known, such as, for example, loose mesh nettings, electrowelded nettings, and single, double or triple twisted hexagonal mesh nettings. Each netting typology generally has a specific application, depending on the technical characteristics of the metal wires forming it and on how those wires are mutually arranged. Thus, for example, an electrowelded netting is generally made up of a plurality of longitudinal wires and a plurality of transverse wires welded with each other at the intersection points so as to form a frame with square and/or rectangular meshes. Electrowelded nettings can be formed by metal wires with diameters of even 12 mm, thereby exhibiting a high tensile mechanical strength.

Another example of a netting is that formed by a plurality of crossed steel cables or ropes arranged angled, and preferably perpendicular, with one another. The ropes can even have a diameter of 10-12 mm and, at the intersection points, are interlocked with one another by means of various types of connecting devices, the most common of which comprise a pair of steel bars which wrap around the abovementioned intersection points very tightly with coils. These nettings exhibit a high tensile strength, and, at the same time, sufficient flexibility to absorb the energy of the bodies which strike them and which rest on them, for example, stones, rocks or similar. An example of this type of netting is illustrated and described in European patent EP 0 940 503 of the same Applicant.

As mentioned above, each of the known netting types is particularly suited to be applied under specific conditions. However, in some cases, the use of a correct typology of netting can be inconvenient, of little advantage and very costly. For example, the installation of a containment netting with high tensile strength characteristics can be complex due to transport difficulties, not very economical due to the costs of the material from which it is made, and difficult to install due to its stiffness.

Another drawback of the known types of nettings described above is that they achieve a high tensile strength for containment but cannot ensure total protective safety since the meshes of the nettings have dimensions such that fragments of rock or other fine material can pass through. For this reason, all the typologies of nettings described above must also be paired with panels of double twisted metal nettings with hexagonal meshes having dimensions that are less than the meshes of the main nettings so as to create a sort of filter. This feature, however, makes the installation of the overall containment structure more complex and costly.

In completely different sectors, for example garden fences and similar, nettings are known in which the wires are interwoven in a very simple way, twisting the contiguous wires from a point in the middle of each mesh. Examples of such nettings are indicated in patents U.S. Pat. Nos. 1,401,557 and 2,053,221. In essence, in each interweave area, two wires meet and are twisted together clockwise for one half of the interweave, and anticlockwise for the other half. Some embodiments provide for a third wire to be bound between the interwoven wires, which is placed rectilinearly through the middle of each mesh of the netting. Clearly, by applying even only a modest tensile stress on the interweave in a direction transverse to the main direction along which the interwoven wires of the netting are stretched, the interweave opens. These nettings are a completely unsuitable for earth containment applications and for protection from falling rocks.

The aim of the present invention is to overcome the drawbacks of some containment and protection structures of known type, providing a metal netting which can withstand high tensile forces and which is flexible, light and easy to handle.

Another aim of the present invention is to provide a protective metal netting that can be produced economically using a traditional type of machine-based manufacturing process.

In order to achieve the aims indicated above, a subject of the invention is a protective metal netting of the type comprising an array of straight extended elements predominantly in a main direction and bent or folded with alternating loops in a direction transverse to the main direction. The extended elements, for example metal wires or cables, are looped in order to interweave one with the other in interweave portions comprising only two interwoven extended elements, and to thus create the meshes of the metal netting. The array of extended elements is advantageously made up of a first group of extended elements, comprising a plurality of extended elements having a first strength, and of a second group of extended elements comprising at least one extended stiffening element having a second strength, greater than the first strength. The at least one extended stiffening element of the abovementioned second group of extended elements, i.e. of those elements with a strength greater than the other extended elements, is bent or folded with alternating loops substantially less pronounced in the transverse direction compared with the alternating loops with which the extended elements of the first group of extended elements are bent. In other words, the at least one extended stiffening element is more "stretched" in the predominant direction of the extended elements of the netting, in order to be able to achieve, or almost achieve, a rectilinear configuration or close to a rectilinear configuration, or in any case "more rectilinear" than the lower-strength extended elements.

According to one embodiment, the at least one extended stiffening element is a high-strength metal wire.

According to another embodiment, the at least one extended stiffening element exhibits a load strength of around 1700 $N/m^2$.

According to yet another embodiment, the at least one extended stiffening element of the second group of extended elements has a diameter at least double the diameter of the extended elements of the first group of extended elements.

According to a further embodiment, the metal netting comprises a plurality of extended stiffening elements of the second group of extended elements, arranged interwoven in the metal netting one every two or more extended elements of the first group of extended elements, in such a way that in the meshes of the netting there is one high-strength extended element every, for example, two or three or four or five or six or more low-strength extended elements.

According to another feature, there is described a machine for manufacturing metal nettings of the type indicated above, comprising feeding means for feeding extended elements predominantly in one main direction, interweaving means for bending or folding the extended elements in alternating loops in a direction transverse to the main direction and interweaving them one with the other in interweave portions, a cylindrical drum on the outer surface of which are fixed a plurality of pins protruding radially and arranged in axial rows at equal angular intervals, with equal pitch in all the rows, on which lines of extended elements are bound. In this machine, some pins are fitted out-of-alignment with respect to the abovementioned pitch.

According to one embodiment, the abovementioned machine comprises a vice assembly formed by individual wire-tensioning devices close to the cylindrical drum, the wire-tensioning devices next to the abovementioned out-of-alignment pins being completely loose.

There is also described a method for manufacturing a metal netting, comprising the stages of feeding in one main direction an array of extended elements, and interweaving pairs of said extended elements one around the other in interweave portions in order to form the meshes of the netting. In the method, the array of extended elements is made up of a first group of extended elements comprising a plurality of extended elements having a first strength, and of a second group of extended elements comprising at least one extended stiffening element having a second strength, greater than the first strength, the at least one extended stiffening element of the second group of extended elements being bent or folded with alternating loops substantially less pronounced in the transverse direction compared with the alternating loops with which the extended elements of the first group of extended elements are bent.

In order to implement the abovementioned method, the abovementioned machine is preferably used.

When the extended stiffening elements are metal cables or wires produced from high-strength steel, these stiffening elements, having a strength on average four times greater than the other extended elements of the netting, provide for increasing the tensile strength of the netting in its entirety.

Furthermore, experimental tests conducted by the Applicant have shown that if the metal cable or wire is interwoven at the meshes of the netting in such a way that the angle between at least one interweave portion and at least one cable or wire before or after said interweave portion is substantially equal to or close to a straight angle, i.e. when this metal cable or wire has a development substantially or almost rectilinear along the netting, this configuration enables such a wire to act almost immediately when the netting is placed under tensile stress, rapidly countering the pressure exerted by a boulder or a rock striking the metal netting. Conversely, if the wire or cable has a curvilinear, or generally non-rectilinear, development with loops that are equal or of a size greater than the loops of the other lower-strength wires, the pressure exerted by the boulder or by the rock would immediately result in stressing the meshes of the lower-strength netting causing it to deform and actually risking breakage of the entire netting before the higher-strength wire or cable can exercise its own resistance action.

A further advantage of the present invention lies in the fact that the containment and protection structure can be made up only of the metal netting of the present invention without the addition of more netting panels for holding back fragments of rocks, stones or similar.

The metal netting according to the present invention can with difficulty be obtained by means of the machines for manufacturing nettings of known type and available commercially at the present time. The Applicant has carried out numerous attempts and conducted a number of tests before succeeding in producing a machine by which a metal netting according to the present invention can be obtained. However, a particularly advantageous feature of the present invention is that it is possible to obtain the new machine for manufacturing the metal netting of the present invention by modifying one of the already-existing manufacturing machines.

Figure 2:
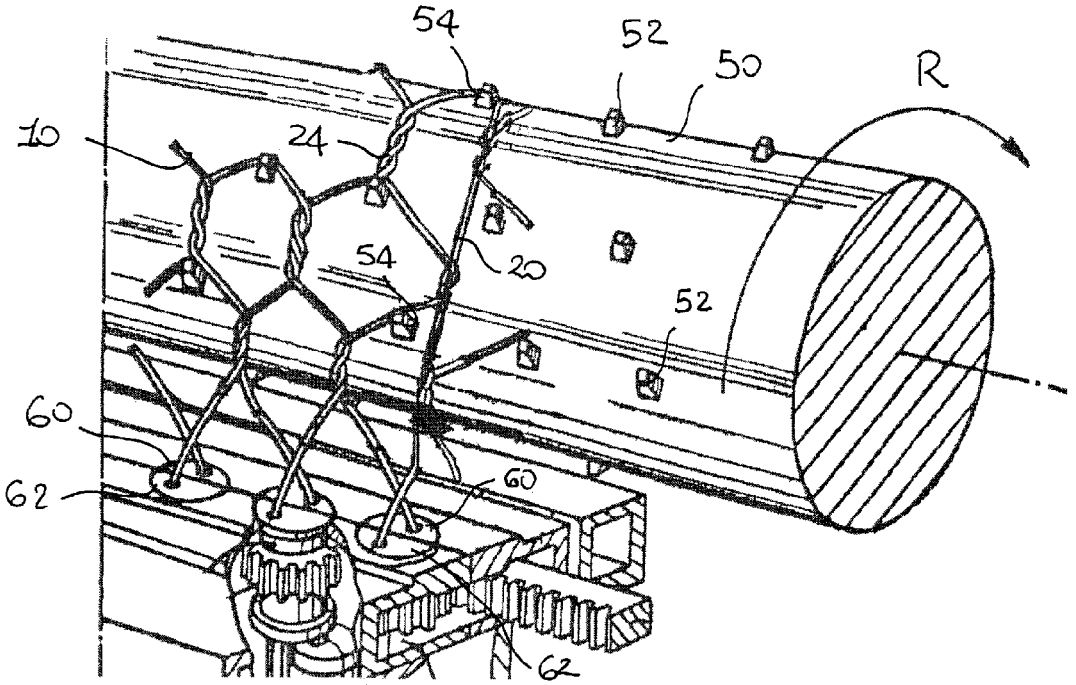

Other features and advantages will emerge from the following detailed description of a preferred example embodiment, with reference to the appended drawings, which are provided purely by way of non-limiting example, and in which:

FIG. 1 is a schematic view of a metal netting according to the present invention; and FIG. 2 is a perspective view of a detail of the machine for manufacturing a netting according to the present invention.

With reference to FIG. 1, a protective metal netting according to the present invention comprises an array of longitudinal metal wires or cables 10, extended in a preferred longitudinal direction, side by side and interwoven, each one with at least one respective adjacent longitudinal wire or cable in an interweave portion 24. Such interweave portions are defined by the lines of respective wires or cables which are twisted one around the other in a unidirectional twist direction, i.e. in only one direction, clockwise or anticlockwise, for each interweave portion.

The netting can be made up of metal wires or cables, made of common steel, with diameters of 2-3 mm, and is flexible and easy to transport. The netting can be double twisted hexagonal mesh, but naturally it is possible to also obtain the present invention with nettings with interwoven wires or cables of different typology. The angle between an interweave portion 24 and the longitudinal portion of metal wires or cables 10 close to said interweave is approximately equal to 270°, or 3/2 of a straight angle.

As illustrated FIG. 1, according to the present invention, inside the array of longitudinal wires or cables 10 forming the netting, at least one 20 of said longitudinal wires or cables, having a stiffening function, has a rectilinear development along said preferred direction. By rectilinear development, it is understood that the angle between at least one interweave portion 24 and a portion of at least one stiffening wire or cable 20, before or after said interweave portion 24 along said preferred direction, is substantially equal to or close to a straight angle, or in any case that its loops for the interweaving with the adjacent wires or cables are not very pronounced. As is clearly visible in FIG. 1, in which for clarity of illustration the stiffening wire or cable 20 is schematically represented as rectilinear, the meshes near the stiffening wire 20 modify the hexagonal structure. The meshes arranged laterally with respect to the rectilinear wire 20 alternately assume a configuration nearing or similar to an isosceles trapezium and a configuration nearing or close to or similar to a six-sided polygon. Such modifications do not however alter the technical features of holding capability and tensile strength of the netting as a whole.

Although the distribution of the rectilinear wires or cables 20 in the metal netting is substantially uniform, it is possible to vary their position in predetermined areas. In particular, it has been found that, in terms of strength, it is particularly advantageous to arrange the rectilinear wires or cables 20 at regular distances within a range of 20 cm to 1.5 meters, with preferred distances of 25 and 40 centimetres, or at predetermined mesh intervals, for example every four meshes. However such values must not in any way be considered limiting aspects of the invention.

According to a particularly advantageous feature of the present invention, the rectilinear metal cable or wire 20 is formed by a high-strength metal wire, for example, but in a non-limiting way, with a load strength of around 1700 $N/m^2$. These wires, having a strength on average four times greater than the interwoven longitudinal wires 10, increase the tensile strength of the netting as a whole. Furthermore, when the netting is subjected to a tensile load stress, the rectilinear wire or cable 20 immediately puts up a resistance to the load, while the remaining meshes of the netting start to deform. As a result, deformation until breakage of the entire netting is avoided.

The protective metal netting according to the present invention is produced by means of a particular manufacturing machine. Machines for manufacturing interwoven wire nettings of known type generally comprise:

a plurality of means for feeding metal wires 10, 20;

interweaving means for the interweaving and/or interconnecting of free ends of pairs of metal wires;

a cylindrical drum 50, or beam, on which the weaving stage takes place and comprising on its outer surface a plurality of teeth 52 protruding radially and arranged in regular rows and with a predefined pitch; and an advancement roller and reels for collecting and rolling up the metal netting.

The means for interweaving and/or interconnecting the metal wires comprise a series of pairs of first guide devices 60, spaced out from each other and coaxial, arranged in rows parallel to the axis of the beam 50 on one side of the plane of symmetry tangent to the cylindrical periphery of the beam 50. The pairs of guide members are arranged in planes that are radial with respect to the beam and their pitch is equal to that of the teeth 52 on the beam 50. The means for interweaving and/or interconnecting metal wires further comprise a series of pairs of second guide devices 62, spaced out from each other and coaxial, arranged on the other side of the plane of symmetry tangent to the beam 50. Each pair of second guide devices is arranged specularly opposed, with respect to the plane of symmetry, to one of the pairs of first guide devices. The pairs of first and second devices can be moved simultaneously by a half pitch in opposite directions parallel to the axis of the beam 50. In use, rotation of the guide devices about their axis creates the interweaving of the wires, while movement of the pairs of first and second guide devices in opposite directions parallel to the axis of the beam 50 creates the hexagonal mesh. The interweaving means are naturally coordinated in movements with the displacement of the beam so as to perform, overall, the weaving of the netting.

The beam 50 comprises, as mentioned, on its outer surface a plurality of teeth 52, or staples, protruding radially. The teeth 52 are arranged in axial rows at equal angular intervals, with equal pitch in all the rows. The teeth 52 of alternate rows are mutually staggered by a predetermined distance, preferably equal to half said pitch. In use, the beam 50 is placed in rotation about its axis according to the direction R in order to allow the weaving of the netting.

In the machine according to the present invention, the beam 50 has been modified by removing some teeth 52, where the high-strength metal wire 20 is inserted. In the weaving stage, the high-strength metal wire is woven on the beam but due to the absence of the teeth 52 it maintains a rectilinear development.

In the weaving stage, the netting is formed regularly as in machines of known type, and initially the high-strength metal wire 20 is not excessively stressed in order to allow the regular meshes to form with the adjacent metal wires. After passing under the advancer roller and then being rolled up, the high-strength metal wire 20 straightens out completely maintaining its rectilinear development.

According to a further embodiment of the present invention, illustrated in FIG. 2, the beam 50 comprises a series of teeth 54 fitted out-of-alignment with respect to their normal pitch, at which teeth 54 the high-strength metal wire 20 is inserted. Even in this case, in the weaving stage, the high-strength metal wire 20 is woven on the beam but, due to the abovementioned out-of-alignment of the teeth 54, it maintains its rectilinear development.

A particularly advantageous feature of the present invention lies in the fact that the machine, upstream of the beam 50, also comprises a vice assembly for the wires of the netting formed by individual wire-tensioning devices used to place the individual wires coming from the feeding means under tension. The wire-tensioning devices arranged at the metal wires intended for the rectilinear development inside the netting are completely loose during production, thus favouring the abovementioned the rectilinear development.

Naturally, the principle of the invention remaining the same, the forms of embodiment and details of construction may be varied widely with respect to those described and illustrated, without thereby departing from the scope of the present invention as defined by the appended claims.

The invention claimed is:

1. A protective metal netting comprising an array of straight extended elements predominantly in a main direction and bent or folded with alternating loops in a direction transverse to the main direction in order to be interwoven one with the other in interweave portions comprising only two interwoven extended elements, to thus create meshes of the metal netting, wherein the array of extended elements is made up of a first group of extended elements comprising a plurality of extended elements having a first strength, and of a second group of extended elements comprising at least one extended stiffening element having a second strength, greater than the first strength, wherein said interweave portions are defined by lines of respective extended elements which are twisted one around the other in a unidirectional twist direction, the at least one extended stiffening element of the second group of extended elements being interwoven with two adjacent extended elements and bent or folded with alternating loops substantially less pronounced in the transverse direction compared with the alternating loops with which the extended elements of the first group of extended elements are bent.

2. The metal netting according to claim 1, wherein the at least one extended stiffening element is a high-strength metal wire.

3. The metal netting according to claim 2, wherein the at least one extended stiffening element exhibits a load strength of around 1700 $N/m^2$.

4. The metal netting according to claim 1, wherein the at least one extended stiffening element of the second group of extended elements has a diameter at least double a diameter of the extended elements of the first group of extended elements.

5. The metal netting according to claim 1, wherein the at least one stiffening element comprises a plurality of extended stiffening elements arranged interwoven in the metal netting one every two or more extended elements of the first group of extended elements.

6. A machine for manufacturing the metal netting according to claim 1, comprising:

a feed for feeding the extended elements predominantly in the main direction, an interweaver for bending or folding the extended elements in alternating loops in the direction transverse to the main direction and interweaving them one with the other in interweave portions; and a cylindrical drum on an outer surface of which are fixed a plurality of pins protruding radially and arranged in axial rows at equal angular intervals, with equal pitch in all the rows, on which lines of extended elements are bound, wherein some pins are fitted out-of-alignment with respect to the abovementioned pitch.

7. A method for manufacturing a metal netting, comprising:

feeding in one main direction an array of extended elements; and interweaving pairs of said extended elements one around the other in interweave portions in order to form the meshes of the netting, wherein said interweave portions are defined by lines of respective extended elements which are twisted one around the other in a unidirectional twist direction;

wherein the array of extended elements is made up of a first group of extended elements comprising a plurality of extended elements having a first strength, and of a second group of extended elements comprising at least one extended stiffening element having a second strength, greater than the first strength, the at least one extended stiffening element of the second group of extended elements being interwoven with two adjacent extended elements and bent or folded with alternating loops substantially less pronounced in the transverse direction compared with the alternating loops with which the extended elements of the first group of extended elements are bent.

8. A protective metal netting comprising:

an array of extended elements predominantly in a main direction and bent or folded with alternating loops in a transverse direction transverse to the main direction in order to be interwoven in interweave portions comprising only two interwoven extended elements to thus create meshes of the metal netting;

the array of extended elements comprising a plurality of first extended elements having a first strength and at least one extended stiffening element having a second strength greater than the first strength;

the interweave portions are defined by lines of extended elements which are twisted one around another in a unidirectional twist direction, the at least one extended stiffening element being interwoven with two adjacent first extended elements and bent or folded with alternating loops such that the at least one extended stiffening element is substantially rectilinear.

9. The metal netting according to claim 8, wherein: the at least one extended stiffening element is a high-strength metal wire.

10. The metal netting according to claim 8, wherein: the at least one extended stiffening element exhibits a load strength of around 1700 $N/m^2$.

11. The metal netting according to claim 8, wherein: the at least one extended stiffening element has a diameter at least double a diameter of the first extended elements.

12. The metal netting according to claim 8, wherein:

the at least one extended stiffening element comprises a plurality of extended stiffening elements arranged interwoven in the metal netting between at least two adjacent first extended elements.

* * * * *